US011814989B2

(12) United States Patent
Durocher

(10) Patent No.: US 11,814,989 B2
(45) Date of Patent: Nov. 14, 2023

(54) VANE ARRAY STRUCTURE FOR A HOT SECTION OF A GAS TURBINE ENGINE

(71) Applicant: Pratt & Whitney Canada Corp., Longueuil (CA)

(72) Inventor: Eric Durocher, Boucherville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 17/514,672

(22) Filed: Oct. 29, 2021

(65) Prior Publication Data

US 2023/0135387 A1 May 4, 2023

(51) Int. Cl.
*F01D 9/04* (2006.01)

(52) U.S. Cl.
CPC ..... *F01D 9/041* (2013.01); *F05D 2220/32* (2013.01); *F05D 2240/12* (2013.01)

(58) Field of Classification Search
CPC ..... F01D 9/042; F01D 5/284; F01D 9/041; F01D 5/282; F01D 9/065; F01D 5/147; F01D 5/189; F01D 25/12; F01D 5/187; F01D 9/023; F01D 11/00; F01D 11/005; F01D 25/24; F01D 25/28; F01D 5/18; F01D 5/188; F01D 9/06; F01D 11/001; F01D 5/14; F01D 5/30; F01D 5/3084; F01D 9/02; F01D 9/04; F05D 2300/6033; F05D 2260/30; F05D 2220/32; F05D 2230/642; F05D 2250/41; F05D 2230/64; F05D 2240/80; F05D 2260/941; F05D 2230/50; F05D 2230/60; F05D 2240/12; F05D 2240/126; F05D 2240/128; F05D 2250/42
See application file for complete search history.

(56) References Cited

U.S. PATENT DOCUMENTS

| | | | | |
|---|---|---|---|---|
| 4,369,016 | A | 1/1983 | Dennison | |
| 5,630,700 | A | 5/1997 | Olsen | |
| 7,093,359 | B2 * | 8/2006 | Morrison | F01D 5/284 264/257 |
| 7,950,236 | B2 | 5/2011 | Durocher | |
| 8,015,705 | B2 * | 9/2011 | Wilson, Jr. | F01D 5/189 29/889.3 |
| 8,096,746 | B2 | 1/2012 | Durocher | |
| 8,740,557 | B2 | 6/2014 | Durocher | |
| 10,472,987 | B2 | 11/2019 | Budnick | |

(Continued)

OTHER PUBLICATIONS

EP search report for EP22204440.6 dated Apr. 25, 2023.

*Primary Examiner* — Eric J Zamora Alvarez
(74) *Attorney, Agent, or Firm* — Getz Balich LLC

(57) ABSTRACT

An apparatus is provided for a gas turbine engine. This gas turbine engine apparatus includes a first platform, a second platform, a plurality of vanes and a plurality of beams. The first platform extends axially along and circumferentially about an axis. The second platform extends axially along and circumferentially about the axis. The vanes are arranged circumferentially about the axis. Each of the vanes extends radially across a gas path between the first platform and the second platform. The vanes include a first vane movably connected to the first platform. The beams are arranged circumferentially about the axis. The beams are fixedly connected to the first platform and the second platform. The beams include a first beam extending radially through the first vane.

16 Claims, 8 Drawing Sheets

(56) References Cited

U.S. PATENT DOCUMENTS

| | | | | |
|---|---|---|---|---|
| 11,149,568 | B2 | 10/2021 | Whittle | |
| 2017/0074116 | A1 | 3/2017 | Spangler | |
| 2018/0230836 | A1* | 8/2018 | Tibbott | F01D 25/12 |
| 2020/0088048 | A1* | 3/2020 | Whittle | F01D 9/042 |
| 2020/0200023 | A1* | 6/2020 | Whittle | F01D 9/042 |
| 2020/0256213 | A1 | 8/2020 | Troughton | |
| 2020/0408100 | A1* | 12/2020 | Whittle | F01D 9/041 |

* cited by examiner

VANE ARRAY STRUCTURE FOR A HOT SECTION OF A GAS TURBINE ENGINE

TECHNICAL FIELD

This disclosure relates generally to a gas turbine engine and, more particularly, to a hot section within a gas turbine engine.

BACKGROUND INFORMATION

A hot section within a gas turbine engine includes various hot section components. These hot section components may be exposed to hot gases (e.g., combustion products) flowing through a core gas path extending through the hot section. This exposure to the hot gases may cause the hot section components to thermally expand or contract at different rates, particularly during transient operating conditions. Such differential thermal expansion or contraction may impart internal stresses on the hot section components. There is a need in the art to reduce thermally induced internal stresses within a hot section of a gas turbine engine.

SUMMARY

According to an aspect of the present disclosure, an apparatus is provided for a gas turbine engine. This gas turbine engine apparatus includes a first platform, a second platform, a plurality of vanes and a plurality of beams. The first platform extends axially along and circumferentially about an axis. The second platform extends axially along and circumferentially about the axis. The vanes are arranged circumferentially about the axis. Each of the vanes extends radially across a gas path between the first platform and the second platform. The vanes include a first vane movably connected to the first platform. The beams are arranged circumferentially about the axis. The beams are fixedly connected to the first platform and the second platform. The beams include a first beam extending radially through the first vane.

According to another aspect of the present disclosure, another apparatus is provided for a gas turbine engine. This gas turbine engine apparatus includes a first platform, a second platform, a plurality of vanes and a plurality of beams. The first platform extends axially along and circumferentially about an axis. The second platform extends axially along and circumferentially about the axis with a gas path formed by and radially between the first platform and the second platform. The vanes are arranged circumferentially about the axis. Each of the vanes extends radially within the gas path and is connected to the first platform and the second platform. The beams structurally tie the first platform to the second platform. Each of the beams projects radially through a respective one of the vanes.

According to still another aspect of the present disclosure, another apparatus is provided for a gas turbine engine. This gas turbine engine apparatus includes a vane array structure extending circumferentially about an axis. The vane array structure includes a gas path, a first platform, a second platform, a plurality of vanes and a plurality of beams. The gas path extends axially along the axis through the vane array structure and radially between the first platform and the second platform. A first of the vanes extends radially within the gas path and is attached to the first platform and the second platform. A first of the beams is formed integral with the first platform and the second platform. The first of the beams extends radially through the first of the vanes between the first platform and the second platform.

The beams may include a first beam formed integral with the first platform and/or the second platform.

The vanes may include a first vane connected to the first platform through a sliding joint.

The first beam may be formed integral with the first platform and/or the second platform.

The first platform may include a base and a mount projecting radially out from the base into a bore of the first vane. The first vane may be slidably connected to the mount.

The first vane may be radially spaced from the base by a gap.

The gas turbine engine apparatus may also include a seal element laterally between and sealingly engaged with a sidewall of the first vane and the mount.

The first vane may be fixedly connected to the second platform.

The first vane may be moveably connected to the second platform.

The second platform may include a base and a mount projecting radially out from the base into a bore of the first vane. The first vane may be slidably connected to the mount.

The first vane may be radially spaced from the base by a gap.

The gas turbine engine apparatus may also include a seal element laterally between and sealingly engaged with a sidewall of the first vane and the mount.

The first platform may be configured as an outer platform and may circumscribe the second platform. The second platform may be configured as an inner platform.

The first platform may be configured as an inner platform. The second platform may be configured as an outer platform and may circumscribe the first platform.

The first vane may include a first vane segment and a second vane segment bonded to the first vane segment.

The first vane segment may be bonded to the second vane segment on or about a leading edge of the first vane. The first vane segment may also or alternatively be bonded to the second vane segment on or about a trailing edge of the first vane.

The first vane may have a blunt leading edge.

The first vane may have a sharp leading edge.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
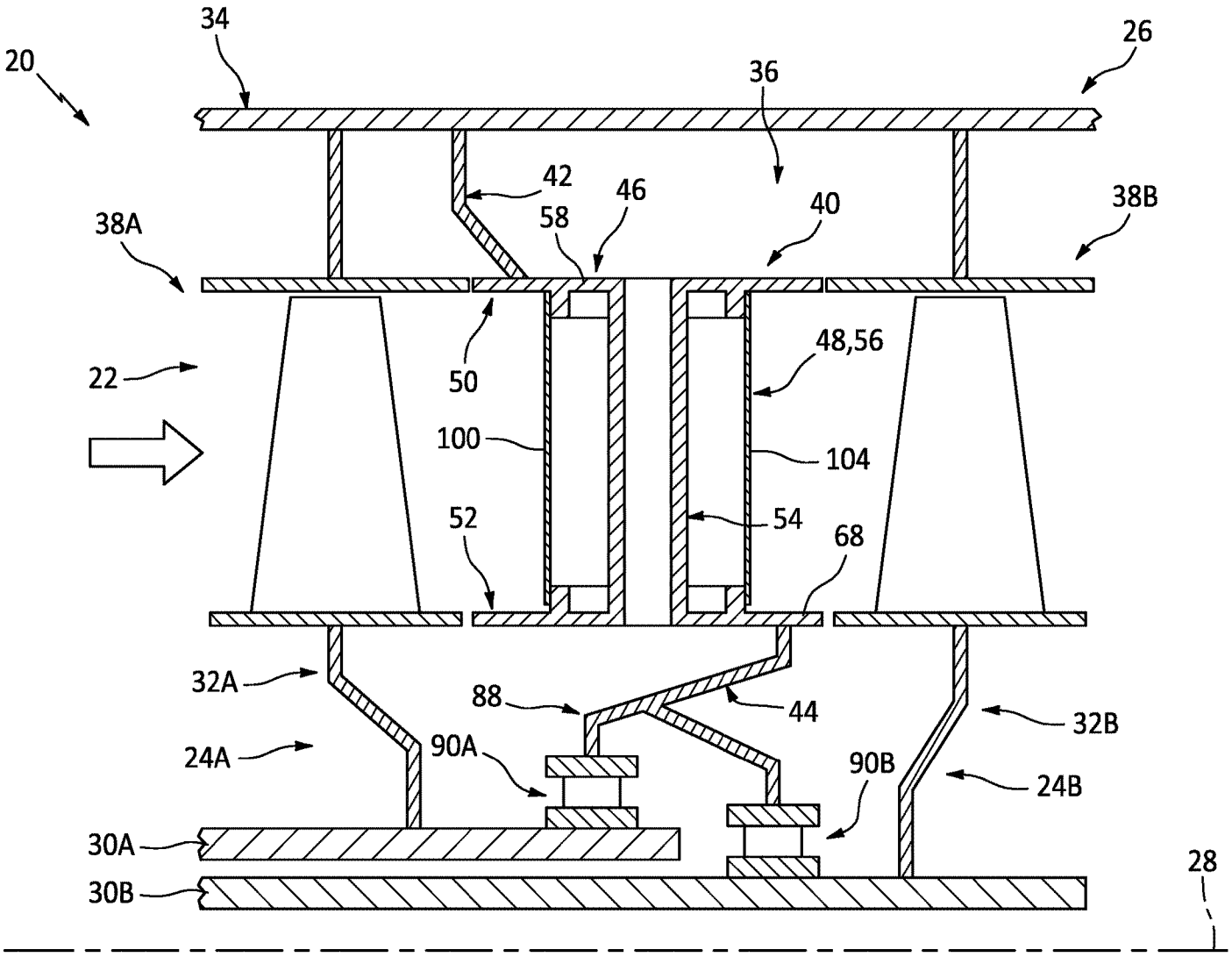
FIG. 1 is a schematic sectional illustration of a portion of a hot section for a gas turbine engine.

FIG. 1 illustrates a hot section 20 of a gas turbine engine. The term "hot section" describes herein a section of the gas turbine engine exposed to hot gases; e.g., combustion products. A (e.g., annular) core gas path 22 of the gas turbine engine, for example, extends longitudinally through the hot section 20 of FIG. 1. Examples of the hot section 20 include, but are not limited to, a combustor section, a turbine section and an exhaust section. However, for ease of description, the hot section 20 of FIG. 1 is described below as a turbine section of the gas turbine engine. The hot section 20 of FIG. 1 includes one or more rotor assemblies 24A and 24B (generally referred to as "24") and a stationary structure 26.

Each of the rotor assemblies 24 is configured to rotate about a rotational axis 28 of the gas turbine engine, which rotational axis 28 may also be an axial centerline of the gas turbine engine. Each of the rotor assemblies 24A, 24B includes a shaft 30A, 30B (generally referred to as "30") and at least a hot section rotor 32A, 32B (generally referred to as "32"); e.g., a turbine rotor. The shaft 30 extends axially along the rotational axis 28. The hot section rotor 32 is connected to the shaft 30. The hot section rotor 32 includes a plurality of hot section rotor blades (e.g., turbine blades) arranged circumferentially around and connected to one or more respective hot section rotor disks. The hot section rotor blades, for example, may be formed integral with or mechanically fastened, welded, brazed, adhered and/or otherwise attached to the respective hot section rotor disk(s).

The stationary structure 26 of FIG. 1 includes a hot section case 34 (e.g., a turbine case) and a hot section structure 36. The hot section case 34 is configured to house at least a portion or an entirety of the hot section 20 and its components 30A, 30B and 36. The hot section case 34 extends axially along and circumferentially about (e.g., completely around) the rotational axis 28.

The hot section structure 36 is configured to guide the hot gases (e.g., combustion products) received from an upstream section 38A of the hot section 20 (e.g., a high pressure turbine (HPT) section) to a downstream section 38B of the hot section 20 (e.g., a low pressure turbine (LPT) section) through the gas path 22. The hot section structure 36 of FIG. 1 is also configured to support one or more of the rotor assemblies 24 within the hot section 20 and its hot section case 34. The hot section structure 36 of FIG. 1, for example, is configured as a support structure such as, but not limited to, a turbine frame structure; e.g., a mid-turbine frame. This hot section structure 36 includes a vane array structure 40 and one or more structural supports 42 and 44; e.g., struts, frames, etc.

Figure 2:
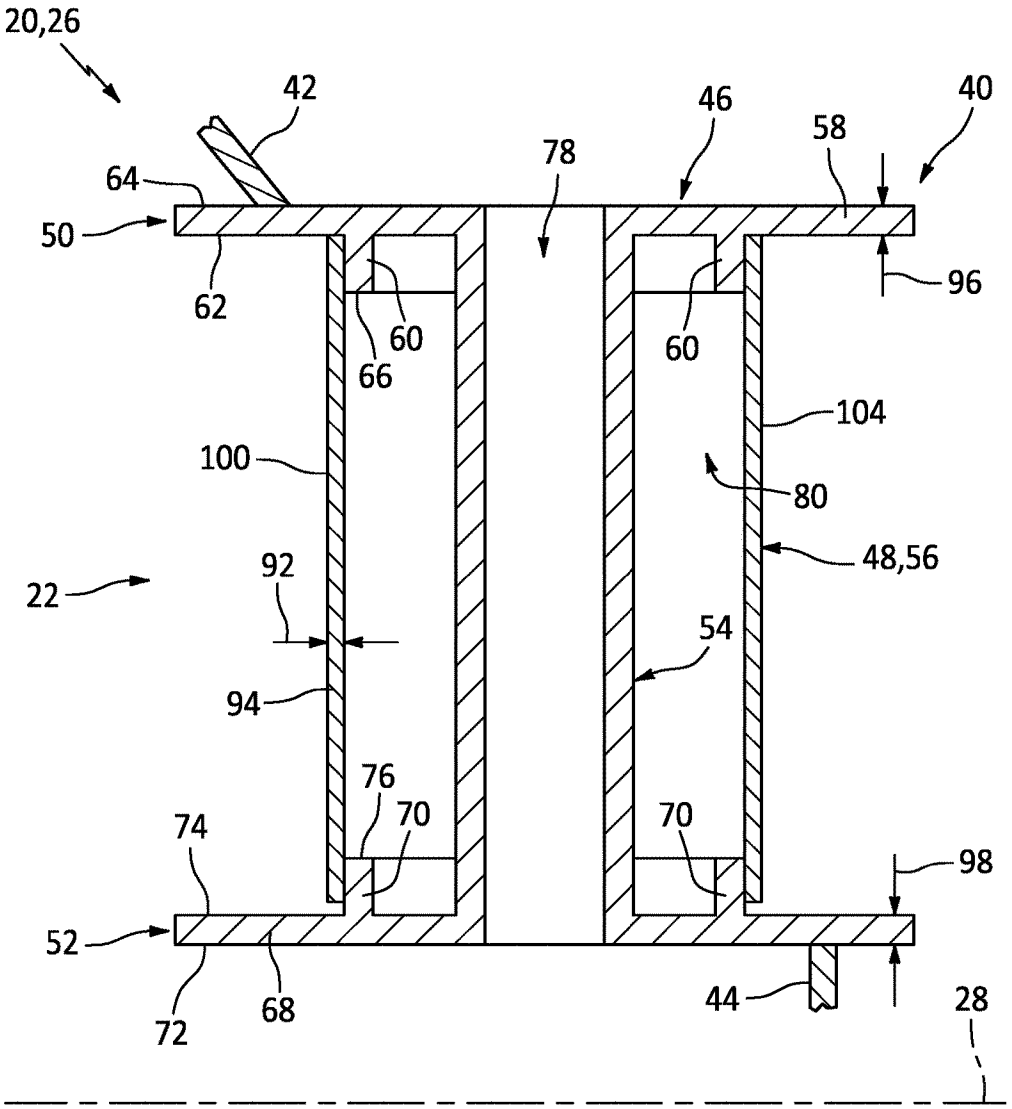
FIG. 2 is a schematic sectional illustration of a portion of a stationary structure for the hot section.

The vane array structure 40 of FIG. 2 includes a plurality of vane array structure members 46 and 48. The first member 46 may be a structural member of the vane array structure configured to structurally tie the outer structural support 42 and the inner structural support 44 together. The first member 46 of FIG. 2, for example, includes an (e.g., tubular) outer platform an (e.g., tubular) inner platform 52 and a plurality of beams 54. Each second member 48 may be a non-structural member of the vane array structure 40 configured to house the beams 54 within the gas path 22. Each second member 48 of FIG. 2, for example, is configured as a non-structural vane 56; e.g., a fairing, a shell and/or a shield for a respective one of the beams 54.

The outer platform 50 includes an outer platform base 58 (referred to below as an "outer base") and a plurality of outer platform mounts 60 (referred to below as "outer mounts"). The outer platform 50 and its outer base 58 extend axially along the rotational axis 28 between an upstream end of the outer platform 50 and a downstream end of the outer platform 50. The outer platform 50 and its outer base 58 extend circumferentially about (e.g., completely around) the rotational axis 28, thereby providing the outer platform 50 and its outer base 58 each with a full-hoop, tubular body. The outer base 58 extends radially between and to an inner side 62 of the outer base 58 and an outer side 64 of the outer base 58. The outer base inner side 62 is configured to form an outer peripheral boundary of the gas path 22 through the vane array structure 40.

Figure 3:
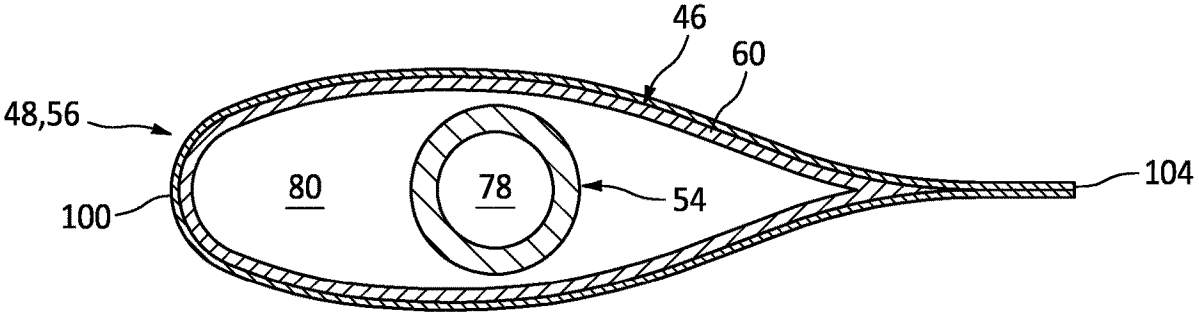
FIG. 3 is a cross-sectional illustration of a portion of the stationary structural at an outer position along a respective vane of the stationary structure.

The outer mounts 60 are distributed circumferentially about the rotational axis 28 in an annular array. Each of the outer mounts 60 is connected to (e.g., formed integral with) the outer base 58 at (e.g., on, adjacent or proximate) its outer base inner side 62. Each of the outer mounts 60 of FIG. 2, for example, projects radially inward from the outer base 58 and its outer base inner side 62 to a (e.g., annular) inner distal edge 66 of the respective outer mount 60. Referring to FIG. 3, each of the outer mounts 60 is axially and circumferentially aligned with a respective one of the beams 54. Each of the outer mounts 60, in particular, circumscribes a respective one of the beams 54. Each outer mount 60 may also be (e.g., completely) laterally spaced/spatially separated from the respective beam 54 by a void; e.g., an annular air gap.

The inner platform 52 of FIG. 2 includes an inner platform base 68 (referred to below as an "inner base") and a plurality of inner platform mounts 70 (referred to below as "inner mounts"). The inner platform 52 and its inner base 68 extend axially along the rotational axis 28 between an upstream end of the inner platform 52 and a downstream end of the inner platform 52. The inner platform 52 and its inner base 68 extend circumferentially about (e.g., completely around) the rotational axis 28, thereby providing the inner platform 52 and its inner base 68 each with a full-hoop, tubular body. The inner base 68 extends radially between and to an inner side 72 of the inner base 68 and an outer side 74 of the inner base 68. The inner base outer side 74 is configured to form an inner peripheral boundary of the gas path 22 through the vane array structure 40.

Figure 4:
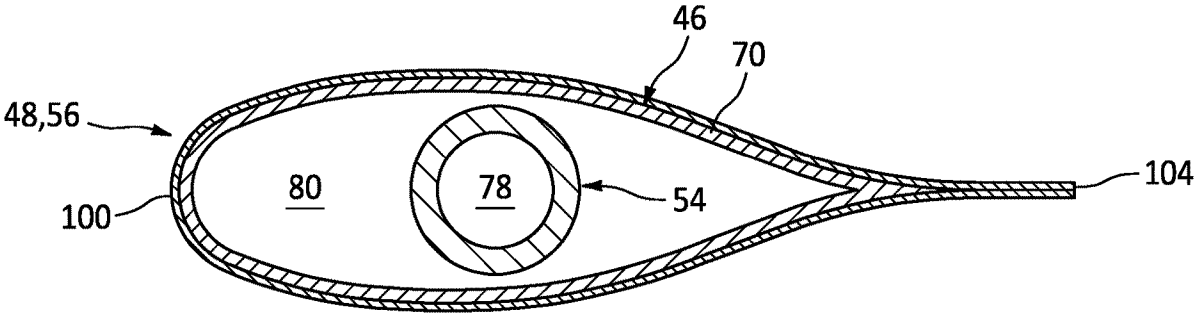
FIG. 4 is a cross-sectional illustration of a portion of the stationary structure at an inner position along the respective vane.
Figure 5:
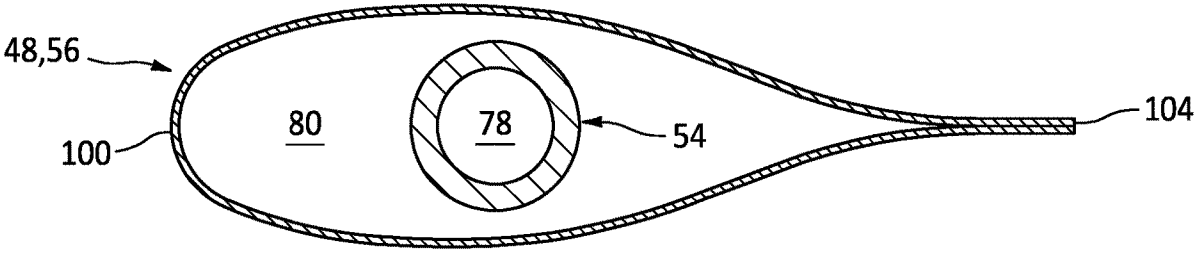
FIG. 5 is a cross-sectional illustration of a portion of the stationary structure at an intermediate position along the respective vane.

The inner mounts 70 are distributed circumferentially about the rotational axis 28 in an annular array. Each of the inner mounts 70 is connected to (e.g., formed integral with) the inner base 68 at (e.g., on, adjacent or proximate) its inner base outer side 74. Each of the inner mounts 70 of FIG. 2, for example, projects radially inward from the inner base 68 and its inner base outer side 74 to a (e.g., annular) outer distal edge 76 of the respective inner mount 70. Referring to FIG. 4, each of the inner mounts 70 is axially and circumferentially aligned with a respective one of the beams 54. Each of the inner mounts 70, in particular, circumscribes a respective one of the beams 54. Each inner mount 70 may also be (e.g., completely) laterally spaced/spatially separated from the respective beam 54 by a void; e.g., an annular air gap.

Referring to FIG. 2, the beams 54 are distributed circumferentially about the rotational axis 28 in an annular array radially between the outer platform 50 and the inner platform 52. Each of the beams 54 extends radially between and to the outer platform 50 and its outer base 58 and the inner platform 52 and its inner base 68.

Each of the beams 54 is fixedly connected to the outer platform 50 and the inner platform 52. Each of the beams 54 of FIG. 2, for example, is formed integral with the outer base 58 and the inner base 68. The outer platform 50, the inner platform 52 and the beams 54, for example, may be cast, machined, additively manufactured and/or otherwise formed as a single unitary body; e.g., a monolithic body. The beams 54 of FIG. 2 may thereby structurally tie the outer platform 50 and its outer base 58 to the inner platform 52 and its inner base 68. Of course, in other embodiments, one or more of the beams 54 may be formed discrete from the outer platform and/or the inner platform 52 and subsequently mechanically fastened, bonded (e.g., welded or brazed) and/or otherwise fixedly attached to the outer platform 50 and/or the inner platform 52.

Referring to FIGS. 2-5, each of the beams 54 may be configured as a hollow beam; e.g., a tubular element. Each of the beams 54 of FIGS. 2-5, for example, has an internal bore 78. This bore 78 extends longitudinally (e.g., radially relative to the rotational axis 28) through the respective beam 54. Referring to FIG. 2, the bore 78 may also extend longitudinally through the outer platform 50 and its outer base 58 and/or the inner platform 52 and its inner base 68.

The vanes 56 are distributed circumferentially about the rotational axis 28 in an annular array radially between the inner platform 52 and the outer platform 50. Each of the vanes 56 extends radially within the gas path 22 between (to or about) the outer platform 50 and its outer base 58 and the inner platform 52 and its inner base 68. Each of the vanes 56 may thereby project radially across the gas path 22.

Figure 6:
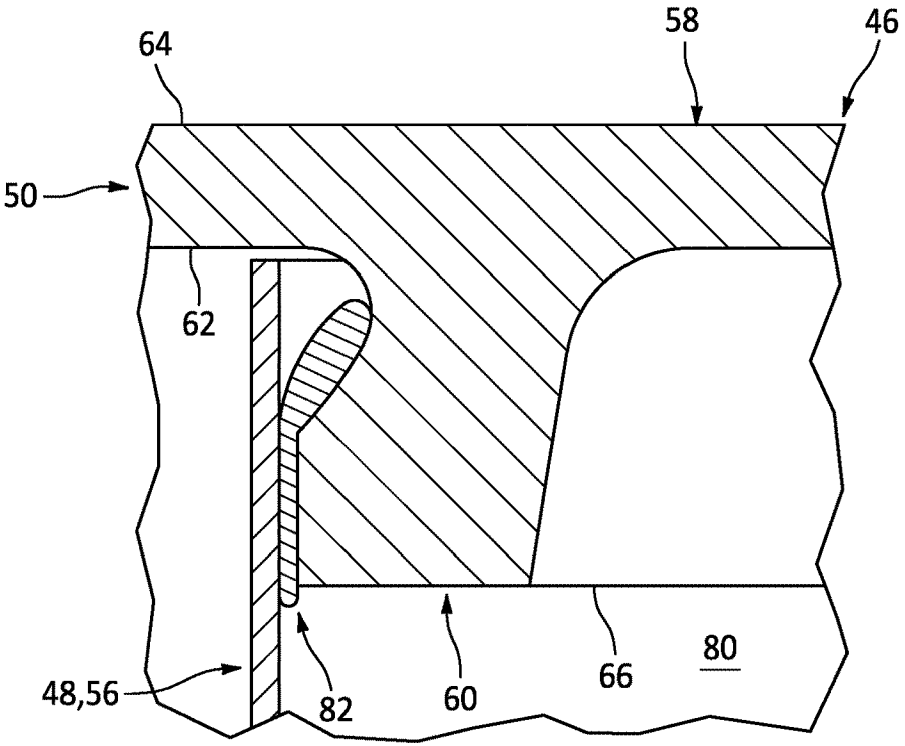
FIG. 6 is a partial sectional illustration of a fixed connection between the respective vane and an outer mount.

Each of the vanes 56 is connected to the outer platform 50. Each of the vanes 56 of FIG. 2, for example, is mated with a respective one of the outer mounts 60. This outer mount projects radially inward from the outer base 58 into a bore 80 of the respective vane 56. Each vane 56 of FIG. 3 circumscribes the respective outer mount 60. Each vane 56 of FIG. 2 laterally engages (e.g., contacts, is abutted against, etc.) an exterior of the respective outer mount 60. Each vane 56 may also be fixedly connected to the respective outer mount 60. For example, referring to FIG. 6, each vane 56 may be welded, brazed and/or otherwise bonded to the respective outer mount 60 by a bond joint 82.

Figure 7:
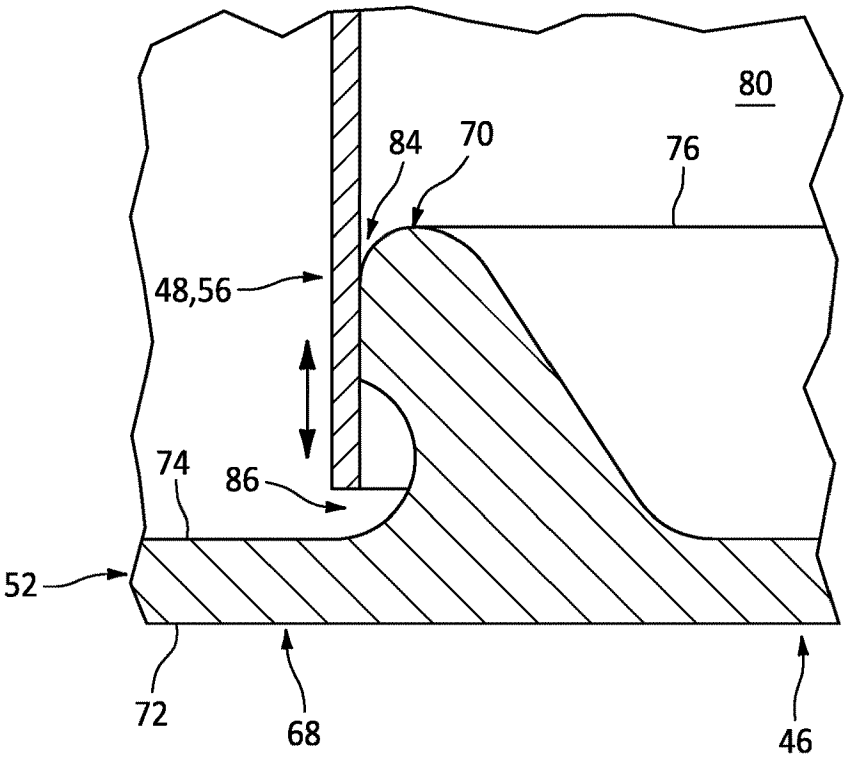
FIG. 7 is a partial sectional illustration of a movable connection between the respective vane and an inner mount.

Each of the vanes 56 of FIG. 2 is connected to the inner platform 52. Each of the vanes 56, for example, is mated with a respective one of the inner mounts 70. This inner mount projects radially outward from the inner base 68 into the bore 80 of the respective vane 56. Each vane 56 of FIG. 4 circumscribes the respective inner mount 70. Each vane 56 of FIG. 2 laterally engages (e.g., contacts, is abutted against, etc.) an exterior of the respective inner mount Each vane 56 may also be movably attached to the respective inner mount 70. For example, referring to FIG. 7, each vane 56 may be slidably connected to the respective inner mount 70 via a slip joint 84 (e.g., a sliding joint, a telescopic joint, etc.) between the elements 56 and 70. To facilitate the movement between the vane 56 and inner mount 70, the respective vane 56 may also be spaced radially from the inner base 68 and its inner base outer side 74 by a void 86; e.g., an annular air gap. With such an arrangement, the respective vane 56 may thermally expand towards the inner platform 52 without, for example, binding; e.g., bottoming out against the inner base outer side 74.

While the vanes 56 of FIG. 2 are described above as being fixedly connected to the outer mounts 60 (see also FIG. 6) and movably connected to the inner mounts 70 (see also FIG. 7), the present disclosure is not limited to such an exemplary arrangement. For example, one or more or all of the vanes 56 may alternatively each be fixedly connected to the respective inner mount 70 and movably (e.g., slidably) connected to the respective outer mount 60. One or more or all of the vanes 56 may still alternatively each be movably (e.g., slidably) connected to both the respective outer mount 60 and the respective inner mount 70.

Each of the beams 54 of FIG. 2 is mated with a respective one of the vanes 56. Each of the beams 54, more particularly, projects radially through a respective one of the vane bores 80 between the outer platform 50 and the inner platform 52. Each of the vanes 56 of FIGS. 2-5 thereby houses and provides an aerodynamic cover for a respective one of the beams 54. With this arrangement, the hot gases flowing through the gas path 22 within the vane array structure 40 are radially bounded and guided by the outer platform 50 and the inner platform 52 and flow around (e.g., to either side of) each vane 56; see also FIGS. 3-5. Each of the vanes 56 of FIGS. 2-5 also forms a thermal shield for a respective one of the beams 54 with a thermal break laterally between the respective beam 54 and vane 56. For example, referring to FIG. 5, a void (e.g., an annular air gap) extends laterally between the respective beam 54 and vane 56. The void of FIG. also circumscribes the respective beam 54.

Referring to FIG. 1, the outer structural support 42 is connected to the outer platform 50 and the hot section case 34. The outer structural support 42 of FIG. 1, for example, projects radially out from the outer base 58 to the hot section case 34. The outer structural support 42 may thereby structurally tie the vane array structure 40 to the hot section case 34.

The inner structural support 44 is connected to the inner platform 52, and rotatably supports one or more of the rotor assemblies 24. The inner structural support 44 of FIG. 1, for example, includes (or is connected to) a bearing support frame 88, and projects radially in from the inner base 68 to the bearing support frame 88. Each shaft 30A, 30B is rotatably supported by a respective bearing 90A, 90B (generally referred to as "90") (e.g., a roller element bearing), which bearing 90 is mounted to and supported by the bearing support frame 88. The inner structural support 44 may thereby structurally tie the rotor assemblies 24 to the vane array structure 40.

Figure 8B:
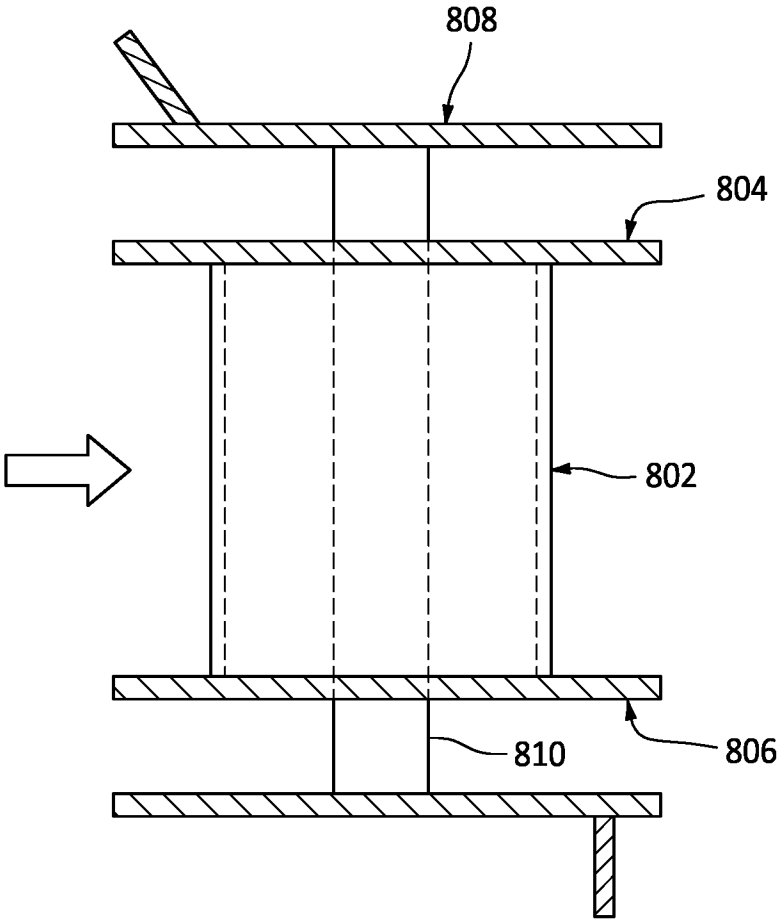
FIGS. 8A and 8B are partial schematic sectional illustrations of various other stationary structures.
Figure 8A:
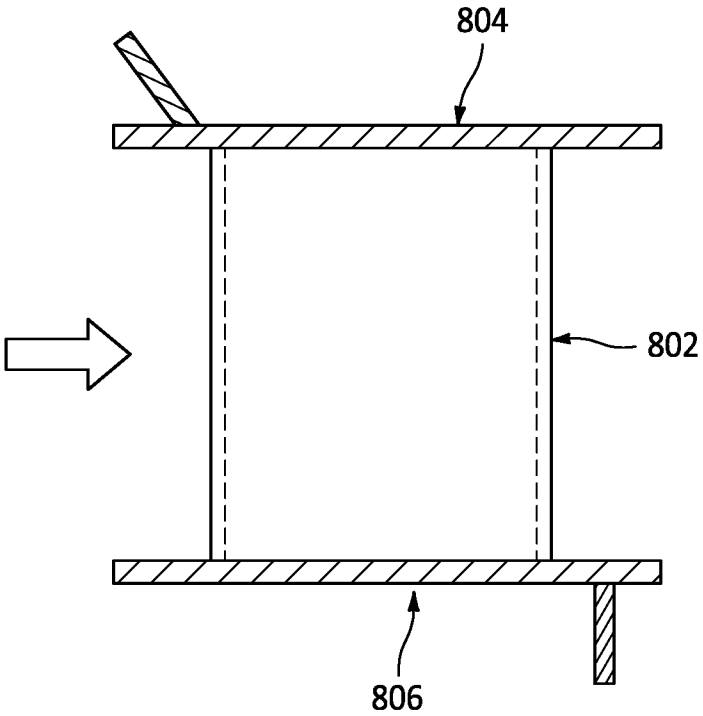

During operation, the vane array structure 40 of FIG. 2 and its components 50, 52 and 56 are exposed to (e.g., are in contact with) the hot gases (e.g., combustion products) flowing through the gas path 22. This hot gas exposure may create a relatively large thermal gradient across the vane array structure 40, particularly during transient operating conditions. For example, a thickness 92 of a sidewall 94 of each vane 56 may be thinner than a thickness 96 of the outer base 58 and/or a thickness 98 of the inner base 68. Furthermore, while the hot gases flow along the outer platform 50, the inner platform 52 and the vane sidewalls 94, the hot gases also impinge against a leading edge 100 of each vane 56. Each vane 56 and its vane sidewall 94 may therefore heat up (or cool down) faster than the outer platform 50 and the inner platform 52. The vane array structure 40 may accommodate this thermal gradient since each vane 56/second member 48 may thermally expand (or contract) radially independent of the first member 46 and its respective beam 54 via the moveable connection (see also FIG. 7) between the respective vane 56 and mount 70 (or the mount 60). Such relative movement between the first member 46 and the second members 48 may reduce internal thermally induced stresses within the vane array structure 40 as compared to another arrangement where each vane 802 is fixedly connected to both outer and inner platforms 804 and 806; e.g., see FIG. 8A. The vane array structure 40 of FIG. 2 may also have a reduced size, complexity and/or mass as compared to a discrete fixed beam arrangement 808 with a beam 810 that is discrete from (e.g., and not structurally tied to) the elements 802, 804 and 806; e.g., see FIG. 8B.

Figure 9:
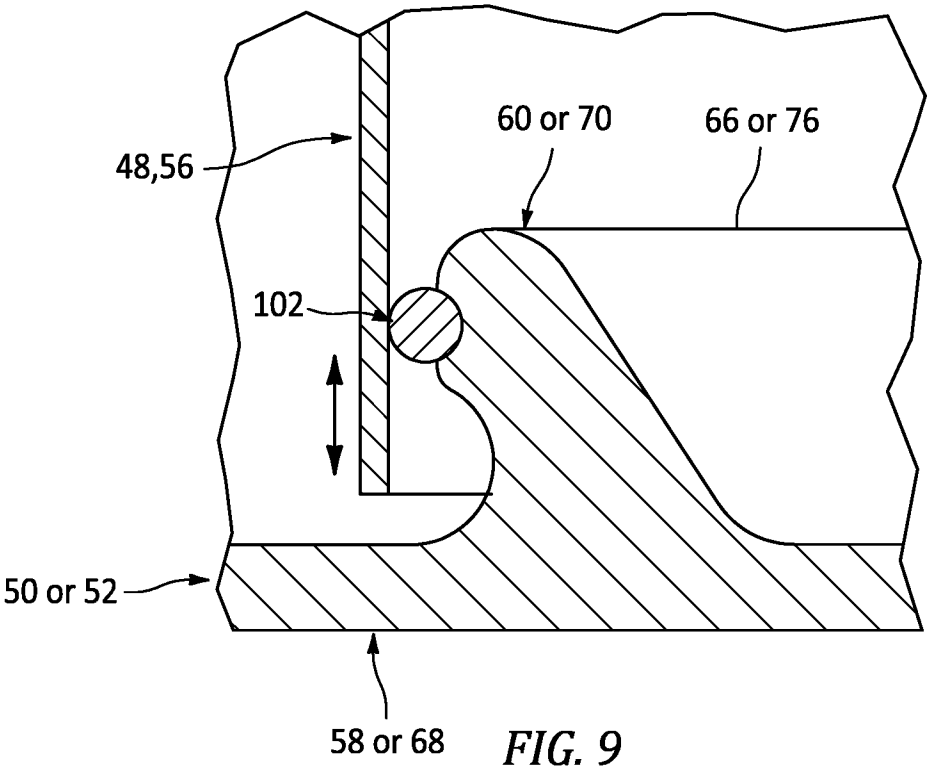
FIG. 9 is a partial sectional illustration of a sealed interface between the respective vane and mount.

In some embodiments, referring to FIG. 9, one or more or all of the vanes 56 may each engage a respective one of the mounts 60, 70 through a seal element 102. This seal element 102 may be configured as or otherwise include a rope seal; e.g., an incobraid rope seal with a core constructed from ceramic fiber wrapped with braided wire metal (e.g., Inconel) material. The seal element 102 may be seated in a notch or groove in the respective mount 60, 70, and laterally engage (e.g., press against, contact, etc.) an interior surface of the respective vane 56. The seal element 102 may thereby provide a sealed interface between the respective vane 56 and the platform 50, 52. The seal element 102 may also facilitate the movable (e.g., slidable) connection between the respective vane 56 and the platform 50, 52. The seal element 102 may also damp vibrations between the elements 56 and 60, 70 as well as hold the respective vane 56 vertically in place via a compression fit. Such a connection may be used between the respective vane 56 and the outer mount 60 and/or the respective vane 56 and the inner mount 70.

Figure 10:
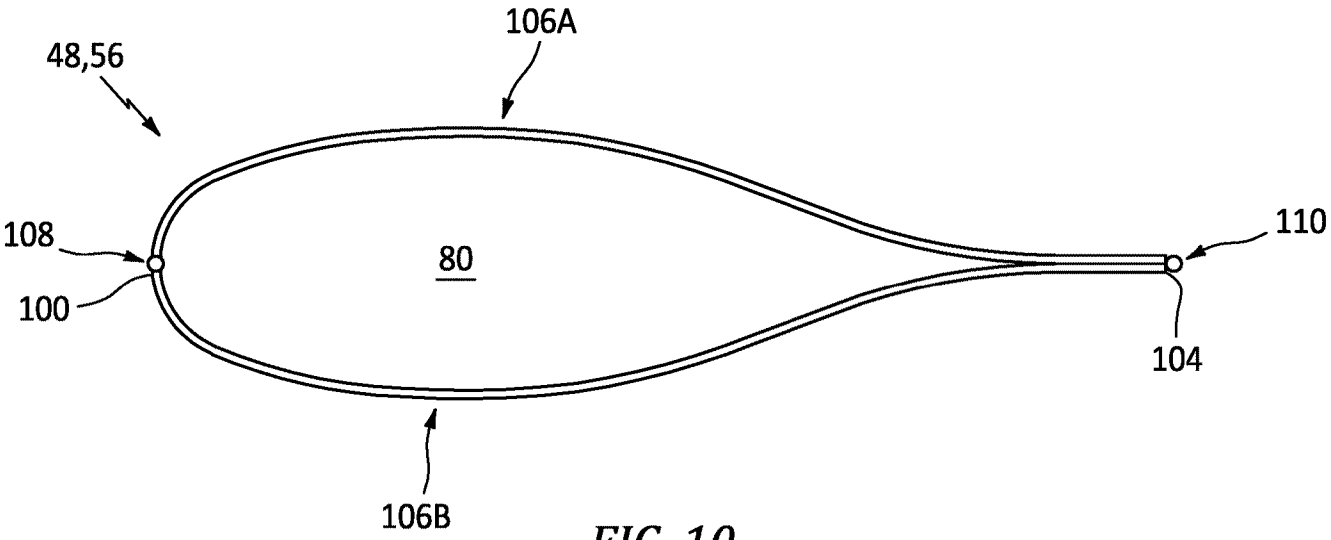
FIG. 10 is a cross-sectional illustration of a segmented vane.

In some embodiments, referring to FIG. 10, one or more or all of the vanes 56 may each be configured with a blunt (e.g., bulbous, curved, etc.) leading edge 100 and a sharp (e.g., pointed, tapered, etc.) trailing edge 104. In other embodiments, referring to FIG. 11, one or more or all of the vanes 56 may each be configured with a sharp leading edge 100 and the sharp trailing edge 104.

Figure 11:
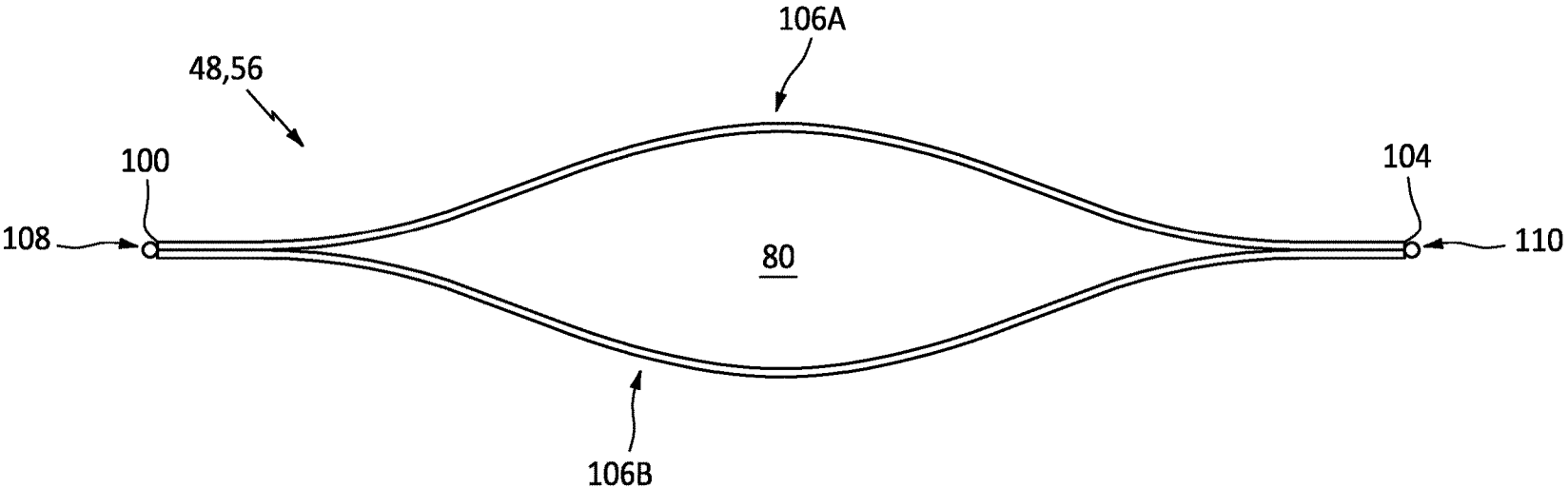
FIG. 11 is a cross-sectional illustration of another segmented vane.

In some embodiments, referring to FIGS. 10 and 11, one or more or all of the vanes 56 may each include plurality of (e.g., sheet metal) vane segments 106A and 106B (generally referred to as "106"); e.g., vane halves, vane sides, etc. Each of these vane segments 106 may extend along an entire radial span of the respective vane 56. The first vane segment 106A may meet the second vane segment 106B at a first interface 108, which first interface 108 may be located at the leading edge 100. The first vane segment 106A is connected (e.g., welded, brazed and/or otherwise bonded) to the second vane segment 106B along the first interface 108. The first vane segment 106A may also or alternatively meet the second vane segment 106B at a second interface 110, which second interface 110 may be located at the trailing edge 104. The first vane segment 106A is connected (e.g., welded, brazed and/or otherwise bonded) to the second vane segment 106B along the second interface 110.

Figure 12:
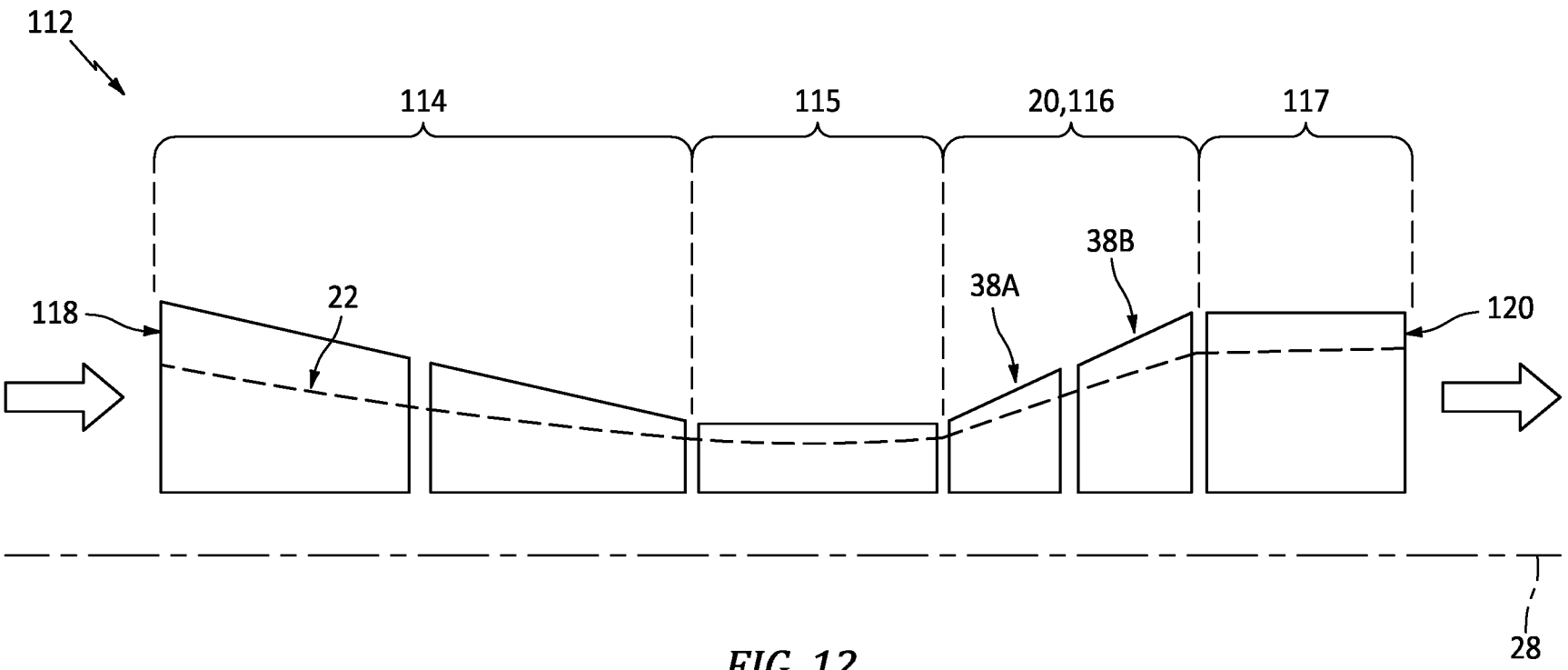
FIG. 12 is a schematic illustration of a gas turbine engine which may include the hot section.

FIG. 12 is a schematic illustration of a gas turbine engine 112 which may include the hot section 20. This gas turbine engine 112 includes a compressor section 114, a combustor section 115, a turbine section 116 and an exhaust section 117. The gas path 22 extends longitudinally sequentially through the compressor section 114, the combustor section 115, the turbine section 116 and the exhaust section 117 from an upstream engine inlet 118 to a downstream engine exhaust 120. During operation, air enters the gas turbine engine 112 and the gas path 22 through the engine inlet 118. This air is compressed by the compressor section 114 and directed into the combustor section 115. Within the combustor section 115, the compressed air is mixed with fuel and ignited to produce the hot gases; e.g., combustion products. These hot gases are directed out of the combustor section 115 and into the turbine section 116 to drive compression within the compressor section 114. The hot gases then flow through the exhaust section 117 and are exhausted form the gas turbine engine 112 through the engine exhaust 120.

The gas turbine engine 112 may be configured as a geared gas turbine engine, where a gear train connects one or more shafts to one or more rotors. The gas turbine engine 112 may alternatively be configured as a direct drive gas turbine engine configured without a gear train. The gas turbine engine 112 may be configured with a single spool, with two spools, or with more than two spools. The gas turbine engine 112 may be configured as a turbofan engine, a turbojet engine, a turboprop engine, a turboshaft engine, a propfan engine, a pusher fan engine or any other type of gas turbine engine. The gas turbine engine 112 may alternative be configured as an auxiliary power unit (APU) or an industrial gas turbine engine. The present disclosure therefore is not limited to any particular types or configurations of gas turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An apparatus for a gas turbine engine, comprising:

a first platform extending axially along and circumferentially about an axis;

a second platform extending axially along and circumferentially about the axis;

a plurality of vanes arranged circumferentially about the axis, each of the plurality of vanes extending radially across a gas path between the first platform and the second platform, and the plurality of vanes comprising a first vane movably connected to the first platform; and a plurality of beams arranged circumferentially about the axis, the plurality of beams fixedly connected to the first platform and the second platform, and the plurality of beams comprising a first beam extending radially through the first vane;

wherein a first side of the first platform forms a first peripheral boundary of the gas path, and a second side of the second platform forms a second peripheral boundary of the gas path that is radially opposite the first peripheral boundary of the gas path.

2. The apparatus of claim 1, wherein the first beam is formed integral with the first platform and the second platform.

3. The apparatus of claim 1, wherein the first platform includes a base and a mount projecting radially out from the base into a bore of the first vane; and the first vane is slidably connected to the mount.

4. The apparatus of claim 3, wherein the first vane is radially spaced from the base by a gap.

5. The apparatus of claim 3, further comprising a seal element laterally between and sealingly engaged with a sidewall of the first vane and the mount.

6. The apparatus of claim 1, wherein the first vane is fixedly connected to the second platform.

7. The apparatus of claim 1, wherein the first vane is moveably connected to the second platform.

8. The apparatus of claim 7, wherein the second platform includes a base and a mount projecting radially out from the base into a bore of the first vane; and the first vane is slidably connected to the mount.

9. The apparatus of claim 8, wherein the first vane is radially spaced from the base by a gap.

10. The apparatus of claim 8, further comprising a seal element laterally between and sealingly engaged with a sidewall of the first vane and the mount.

11. The apparatus of claim 1, wherein the first platform is configured as an outer platform and circumscribes the second platform; and the second platform is configured as an inner platform.

12. The apparatus of claim 1, wherein the first platform is configured as an inner platform; and the second platform is configured as an outer platform and circumscribes the first platform.

13. The apparatus of claim 1, wherein the first vane comprises a first vane segment and a second vane segment bonded to the first vane segment.

14. The apparatus of claim 13, wherein the first vane segment is bonded to the second vane segment on or about at least one of a leading edge of the first vane; or a trailing edge of the first vane.

15. The apparatus of claim 1, wherein the first vane has a blunt leading edge.

16. The apparatus of claim 1, wherein the first vane has a sharp leading edge.

* * * * *